US005946963A

United States Patent [19]

Suzuki et al.

[11] Patent Number: 5,946,963

[45] Date of Patent: Sep. 7, 1999

[54] BEVEL GEAR HOT-FORGING APPARATUS

[75] Inventors: Kouji Suzuki, Utsunomiya; Akihiko Minowa, Tochigi-ken; Shuichi Yamane, Kiyose; Hiroshi Sugita, Tochigi-ken; Seishi Okada, Utsunomiya; Takashi Asada, Hidaka, all of Japan

[73] Assignee: Honda Giken Kogyo Kabushiki Kaisha, Tokyo, Japan

[21] Appl. No.: 09/101,469

[22] PCT Filed: Nov. 10, 1997

[86] PCT No.: PCT/JP97/04087

§ 371 Date: Jul. 10, 1998

§ 102(e) Date: Jul. 10, 1998

[87] PCT Pub. No.: WO98/20994

PCT Pub. Date: May 22, 1998

[30] Foreign Application Priority Data

Nov. 11, 1996 [JP] Japan ..... 8-298770
Oct. 30, 1997 [JP] Japan ..... 9-299008

[51] Int. Cl.[6] ..... B21K 1/30

[52] U.S. Cl. ..... 72/344; 72/352; 29/893.34

[58] Field of Search ..... 29/893.34; 72/344, 72/345, 352, 354.6, 354.8, 360

[56] References Cited

FOREIGN PATENT DOCUMENTS

| | | |
|---|---|---|
| 63-273539 | 11/1988 | Japan . |
| 252141 | 2/1990 | Japan . |
| 4-371335 | 12/1992 | Japan . |
| 631372 | 2/1994 | Japan . |
| 8-257668 | 10/1996 | Japan . |

*Primary Examiner*—Lowell A. Larson
*Attorney, Agent, or Firm*—Birch, Stewart, Kolasch & Birch, LLP.

[57] ABSTRACT

At the time of closing a die mold, an upper die (18) is rotated with respect to screws **(44*a*–44*d*) while being brought into contact with a lower die (14) by means of drive gears (42*a*–42*d*) and a driven gear (40), wherein a closing force is applied to the material (W) by plate springs (60). Subsequently, at the time of opening the die, under an opposite operation, the upper die (18) is opened while being simultaneously rotated with respect to the screws (44*a*–44*d*) which are supported by coil springs (54*a*–54*d*), whereby a spiral bevel gear (72) is released from the mold. Accordingly, at the time of die closing, the closing force is kept stable, whereas when the die is opened, imposition of a large force to the gear teeth is prevented, so that bevel gears (72)** of high quality and high yield rate can be produced.

9 Claims, 11 Drawing Sheets

BEVEL GEAR HOT-FORGING APPARATUS

This application claims the benefit under 35 U.S.C. §371 of prior PCT International Application No. PCT/JP97/04087 which has an International filing date of Nov. 10, 1997 which designated the United States of America, the entire contents of which are hereby incorporated by reference.

1. Technical Field

The present invention concerns a hot-forging apparatus for forming a bevel gear having inclined gear teeth, wherein forging is performed while heat is applied to the material at a fixed temperature.

2. Background Art

A bevel gear, which is constructed with inclined gear teeth, is one type of gear which enables the direction of transmission of a motive force to be varied, and moreover, while being smoothly and quietly effected. Among such known bevel gears are helical bevel gears, spiral bevel gears, hypoid gears, and the like.

FIG. 12 illustrates spiral bevel gears 2 and 4. Such spiral bevel gears 2, 4 intersect at respective axial lines thereof, and are constructed so that their mutually enmeshed gear teeth 2*a* and 4*a* are in an inclined condition.

As methods for producing bevel gears 2, 4 constructed in this manner, spiral-teeth bevel gears are produced, for example, by press working, machining, and/or utilizing specialized gear cutting apparatus. In the case of specialized gear cutting apparatus, a remarkably high cost is involved, and further, because the gear teeth must be cut one by one, there is the disadvantage that a lengthy processing time is required, with poor yield rate.

Hence, an apparatus by which spiral bevel gears 2, 4 are formed by forging has been disclosed in Japanese Laid-Open Patent Publication No. 4-371335. According to this known technique, after forging of a spiral bevel gear material using rotatably disposed upper and lower dies having gear-teeth formations on their interior surfaces thereof, a spiral bevel gear 2, 4 having inclined gear teeth is formed by "knockout" while one of the molds is being rotated.

However, with this known technique, one of the molds, for example the upper mold, is supported for rotation through bearings, and when knockout is performed after formation, the upper mold is rotated depending on the turn angle of the gear teeth 2*a*, 4*a*. Accordingly, especially in the case of a heavy material upper die, the force necessary to rotate the die is directly imposed on the gear teeth, resulting in malformation thereof.

Further, another prior technique is the gear forging die apparatus which is disclosed in Japanese Laid-Open Patent Publication No. 2-52141. This apparatus is constructed by a driven gear which is disposed on the outer peripheral part of a lower die, wherein by means of a screw, and via a drive gear which is enmeshed with the driven gear, the lower die is made to rotate, such that when the die is closed shut and opened, rotation of the lower die is performed by a cylinder which is attached to the screw.

However, according to this technique, especially concerning rotation of the lower die at the time of opening the die, there is a delay caused by the cylinder, whereby synchronization with the opening operation cannot be achieved, resulting in damage to the spiral bevel gear 2, 4.

A principal object of the invention is to provide a bevel gear hot-forging apparatus in which a large force is reliably prevented from being applied to the gear teeth during opening of a forming die, thereby enabling bevel gears of superior quality and high yield rate to be achieved.

DISCLOSURE OF THE INVENTION

At the time of closing a die mold, a bevel gear is formed by a stable die closing force which is sufficiently given to a material by force applying means. If the force applying means comprises a plate spring, a stable die closing force can be constantly obtained. The force applying means has a hydraulic cylinder. A hydraulic fluid supply circuit has a check valve and a relief valve for conducting supply and evacuation of hydraulic fluid. Therefore, a desired surface pressure can be obtained at the time of closing the die mold, so that burrs or mold flashing can be avoided. Further, breakdown of the die can be prevented by properly discharging hydraulic fluid in forming a relatively large workpiece.

Further, at the time of opening the die mold, because a second die rotates through a drive gear and a driven gear against a screw supported by a resilient member, prompt die opening and good synchronization are realized.

Still further, the drive gear has a rotation direction regulating mechanism for making the drive gear rotating in the sole direction. At the time of closing the die mold, the screw and the drive gear are not rotated integrally, so that an unnecessary large force is not applied to the screw in forming.

Figure 1:
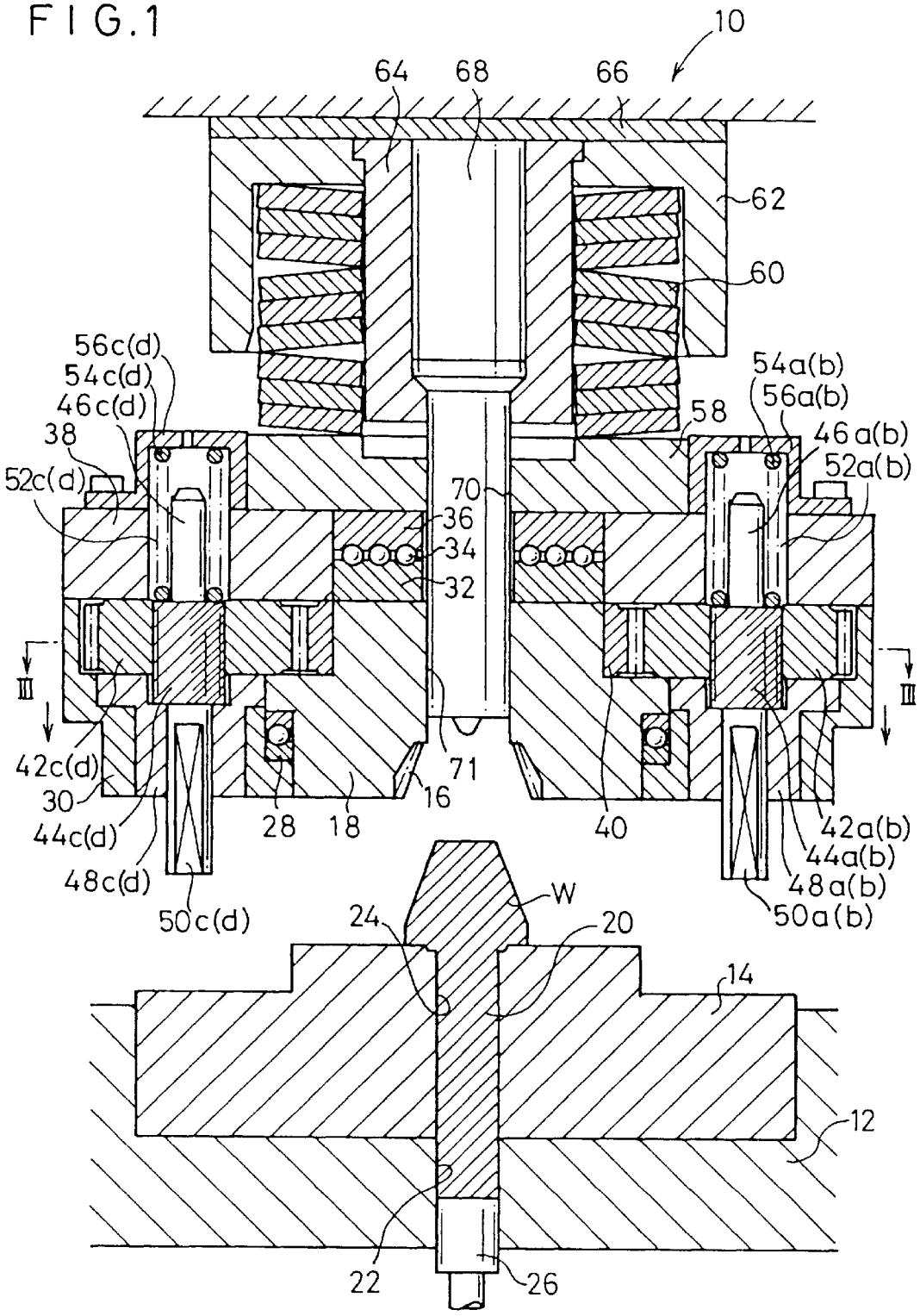
FIG. 1 shows a vertical sectional view of a die opening condition, showing screws, of the forging apparatus according to a first embodiment of the present invention.
Figure 2:
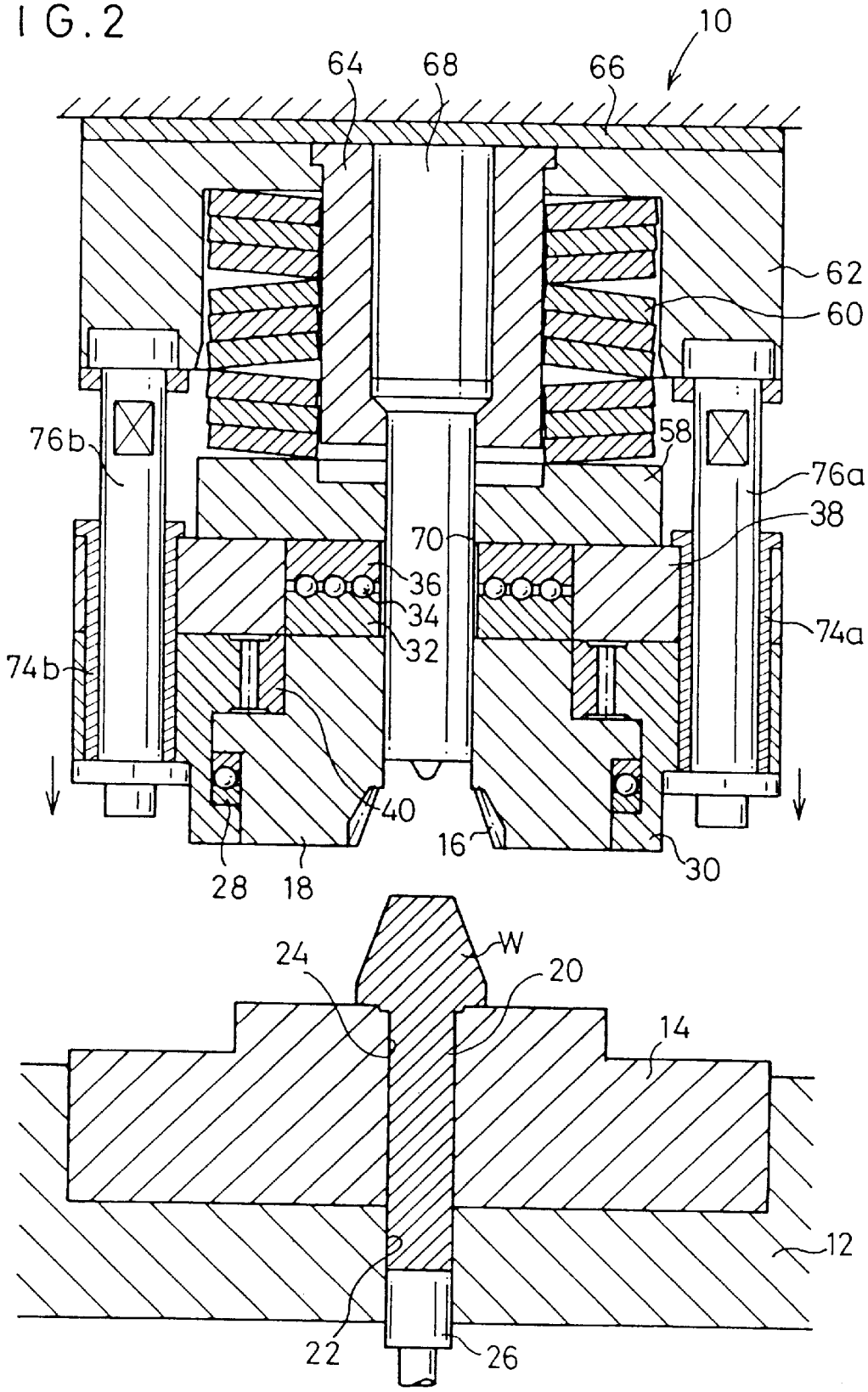
FIG. 2 shows a vertical sectional view of a die opening condition, showing guide pins, of the forging apparatus according to the first embodiment of the present invention.
Figure 3:
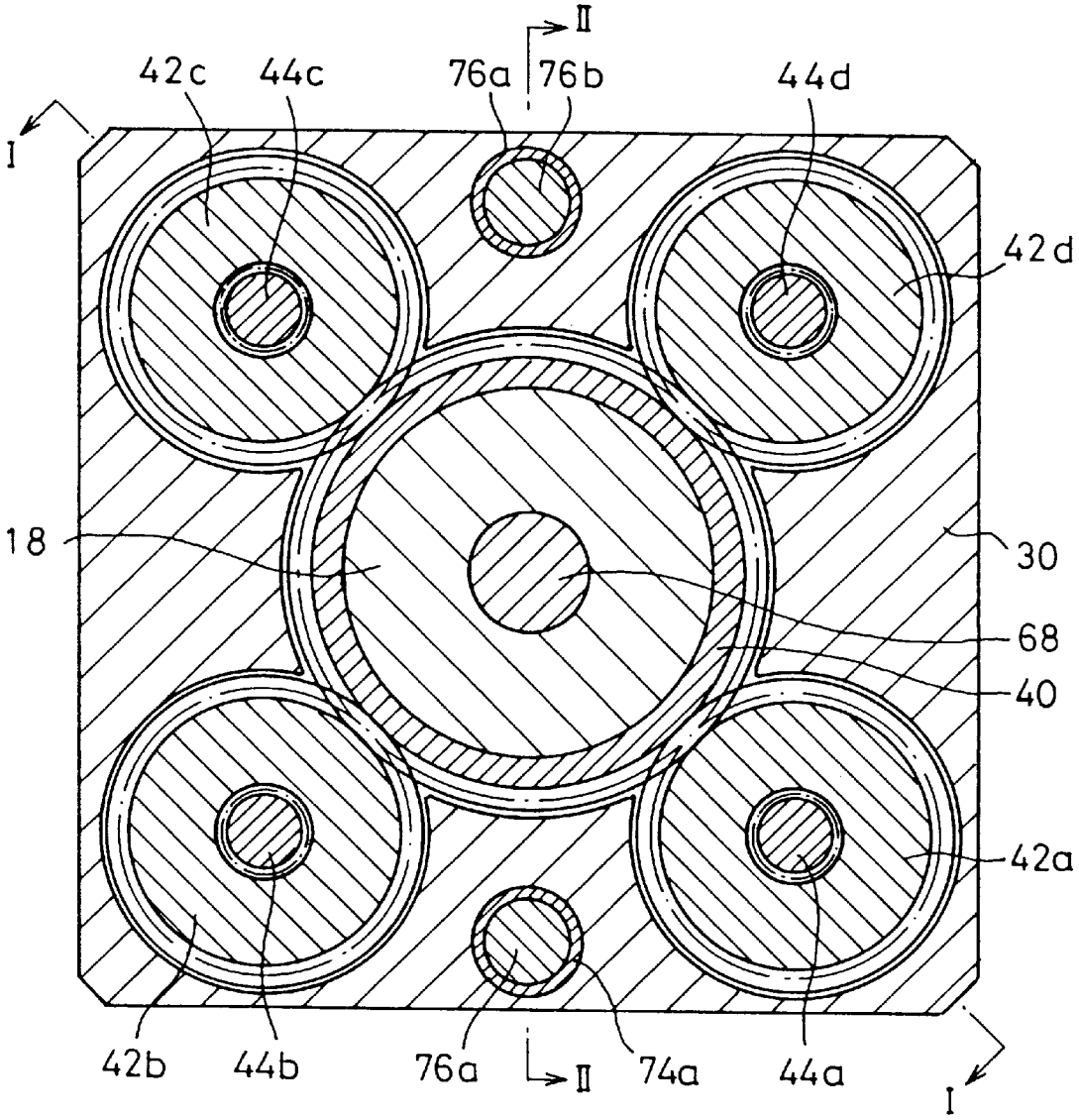
FIG. 3 is a cross-sectional view along line III—III of FIG. 1.

BEST MODE FOR CARRYING OUT THE INVENTION:

FIGS. 1 through 3 show the cross-sectional structure of the forging apparatus 10 of the first embodiment of the present invention. Further, FIG. 1 is a sectional view along line I—I of FIG. 3, FIG. 2 is a sectional view along line II—II of FIG. 3, whereas FIG. 3 is a section view along line III—III of FIG. 1.

The forging apparatus 10 is equipped with a lower die (first die) 14 supported by a die plate 12 and an upper die (second die) 18 comprising a gear teeth forming die 16. The die plate 12 and lower die 14 are formed with holes 22 and 24 therein, through which a material W stem 20 is inserted. A knockout 26 is inserted into the hole 22 in the die plate 12, for ejecting the material W after forging.

The lower outer periphery of the upper die 18 is supported by a first support frame 30 through a bearing 28, and together by a second support frame 38 through a bearing member made up of an inner element 32, balls 34 and an outer element 36 arranged on an upper surface part thereof. The outer element 36 is fixed with respect to the second support frame 38, and the inner element 32 is fixed with respect to the upper die 18. Accordingly, the upper die 18 is rotatably supported with respect to the first support frame 30 and second support frame 38.

A driven gear 40 is attached to the central outer periphery of the upper die 18. As shown in FIG. 3, the driven gear 40 meshes with drive gears 42*a*–42*d* which are arranged at four locations on the first support frame 30. Screws 44*a*–44*d* threadedly engage with threaded holes in the center of each of the drive gears 42*a*–42*d*. The leading angle of screws 44*a*–44*d* is uniformly set with the leading angel of the gear teeth forming die 16. The screw shafts 46*a*–46*d* supporting the screws 44*a*–44*d* are supported by screw holders 48*a*–48*d* which are attached to a lower part of the first support frame 30. On the screw shafts 46*a*–46*d* which are supported by the screw holders 48*a*–48*d*, flat surface parts 50*a*–50*d* are formed which serve to prevent rotation of the screws 44*a*–44*d*. An upper part of the screw shafts 46*a*–46*d* is inserted through holes 52*a*–52*d* formed in the second support frame 38. Coil springs 54*a*–54*d* (resilient members) are inserted into holes 52*a*–52*d*, each of the holes 52*a*–52*d* being closed off by caps 56*a*–56*d*.

A die plate 58 is attached to an upper part of the second die frame 38 and outer member 36, and a plate spring 60 (force applying means) is inserted so as to be supported by a holding tube 62 on top of the die plate 58. A punch holder 64 is inserted in the central part of the plate spring 60, and a set plate 66 is attached to the top of the holding tube 62 and punch holder 64. A center punch 68 is inserted through a central part of the punch holder 64, wherein a lower distal end of the center punch 68 is inserted through a hole 71 formed in the center of the upper die 18, through the hole 70 in the die plate 58, the inner member 32, balls 34, and the outer member 36.

As shown in FIG. 2, sleeves 74*a*–74*b* are attached to the first support frame 30 and second support frame 38, wherein guide bars 76*a*, 76*b* which connect with the holding tube 62, the first support frame 30 and the second support from 38 are inserted through the sleeves 74*a*, 74*b*.

The forging apparatus according to the first embodiment is constructed as described above. Following is an explanation of the operation thereof.

As shown in FIGS. 1 and 2, initially a stem 20 made from a material W to which heat is applied is inserted through the hole 24, and is received in the lower die 14. Subsequently, the upper mechanism of the forging apparatus, including the upper die 18, is lowered toward the lower die 14 having installed therein the material W, while being guided by the guide bars 76*a*, 76*b*.

As the upper die 18 is lowered toward the lower die 14 at a fixed rate, lower distal ends of the screw shafts 46*a*–46*d* are brought into contact with the lower die 14. As the upper die 18 is lowered further, the screws 44*a*–44*d* which are attached to the screw shafts 46*a*–46*d* oppose the elastic force of the coil springs 54*a*–54*d*, and are displaced relative to the upper die 18 in an upward direction. Further, the screws 44*a*–44*d* remain in a non-rotative state with respect to the screw holders 48*a*–48*d* by means of the flat surfaces 50*a*–50*d* formed on the screw shafts 46*a*–46*d*. Consequently, together with displacement of the screws 44*a*44*d*, the drive gears 42*a*–42*d* which are threadedly engaged with the screws rotate, and further, the driven gear 40 enmeshed with the drive gears 42*a*–42*d* also rotates. As a result, the upper die 18 which is supported by the first and second support frames 30, 38 is brought into mutual contact with the lower die while also being rotated.

With the upper die 18 and lower die 14 in a state of mutual contact, closing of the dies is firmly accomplished by a stable elastic force of the plate spring 60. At the same time, by means of the center punch 68 applying a pressing force to the upper part of the material W, the outer periphery of the material W undergoes plastic flow by the gear teeth forming die 16 formed in the upper die 18. As a result, as shown in FIG. 4, a spiral bevel gear 72 having arcuately inclined gear teeth is formed between the lower die 14 and the upper die 18.

Figure 4:
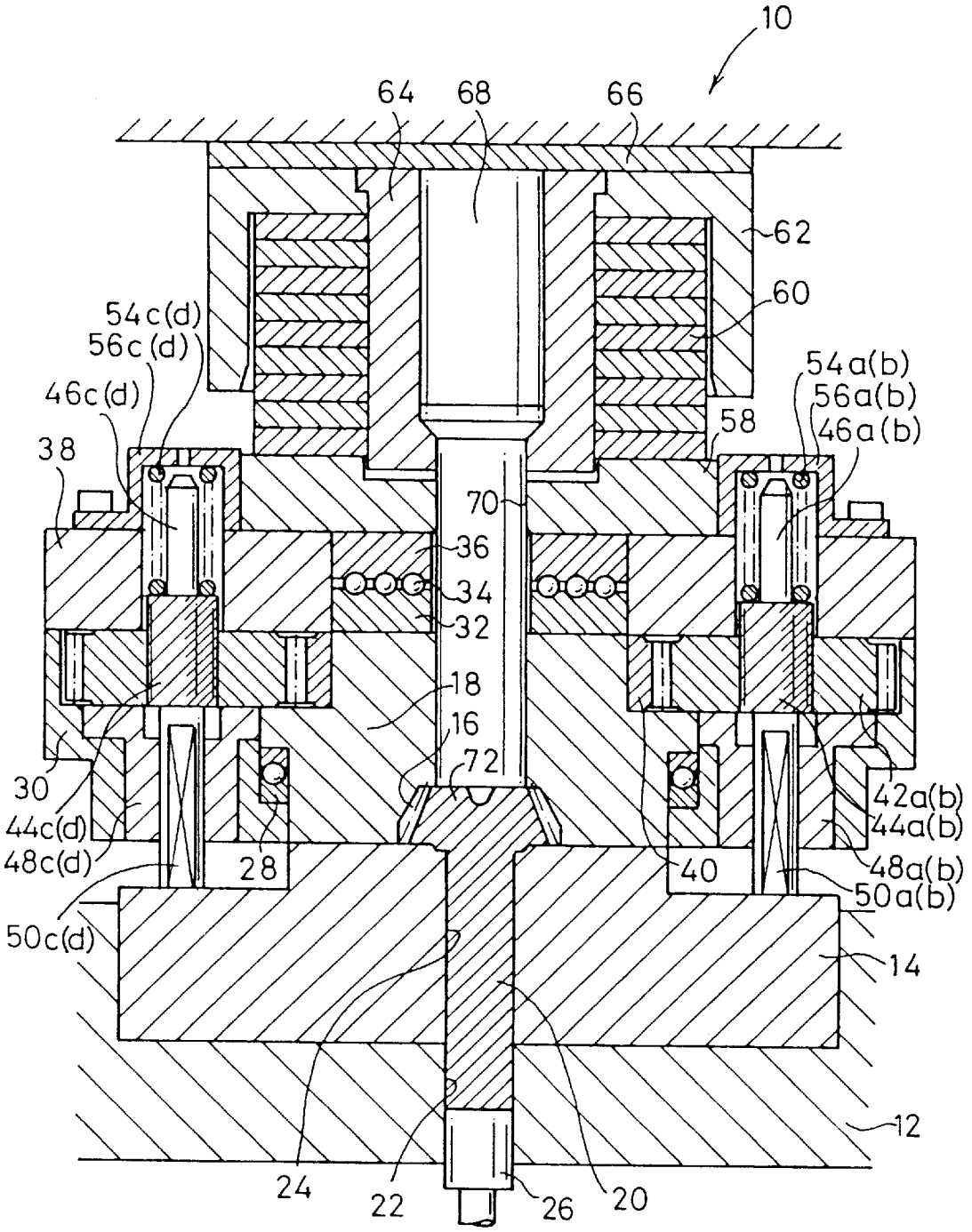
FIG. 4 is vertical sectional view of a die closing condition of the forging apparatus according to the first embodiment of the present invention.

Thereafter, after being maintained in the condition shown by FIG. 4 for a predetermined time period, die opening is performed. In this case, the upper die 18 is raised so as to separate from the lower die, and the screws 44*a*–44*d* which are arranged on the outer periphery thereof are maintained in the position shown by FIG. 1 under the elastic force of the coil springs 54*a*–54*d*. Accordingly, the drive gears 42*a*–42*d* threadedly engaged with the screws 44*a*–44*d* rotate, and thereby the driven gear 40 likewise rotates in turn. Further, as the screws 44*a*–44*d* have force applied thereto from the coil springs 54*a*–54*d*, simultaneously with opening of the dies, the upper die 18 begins to rotate.

Figure 5:
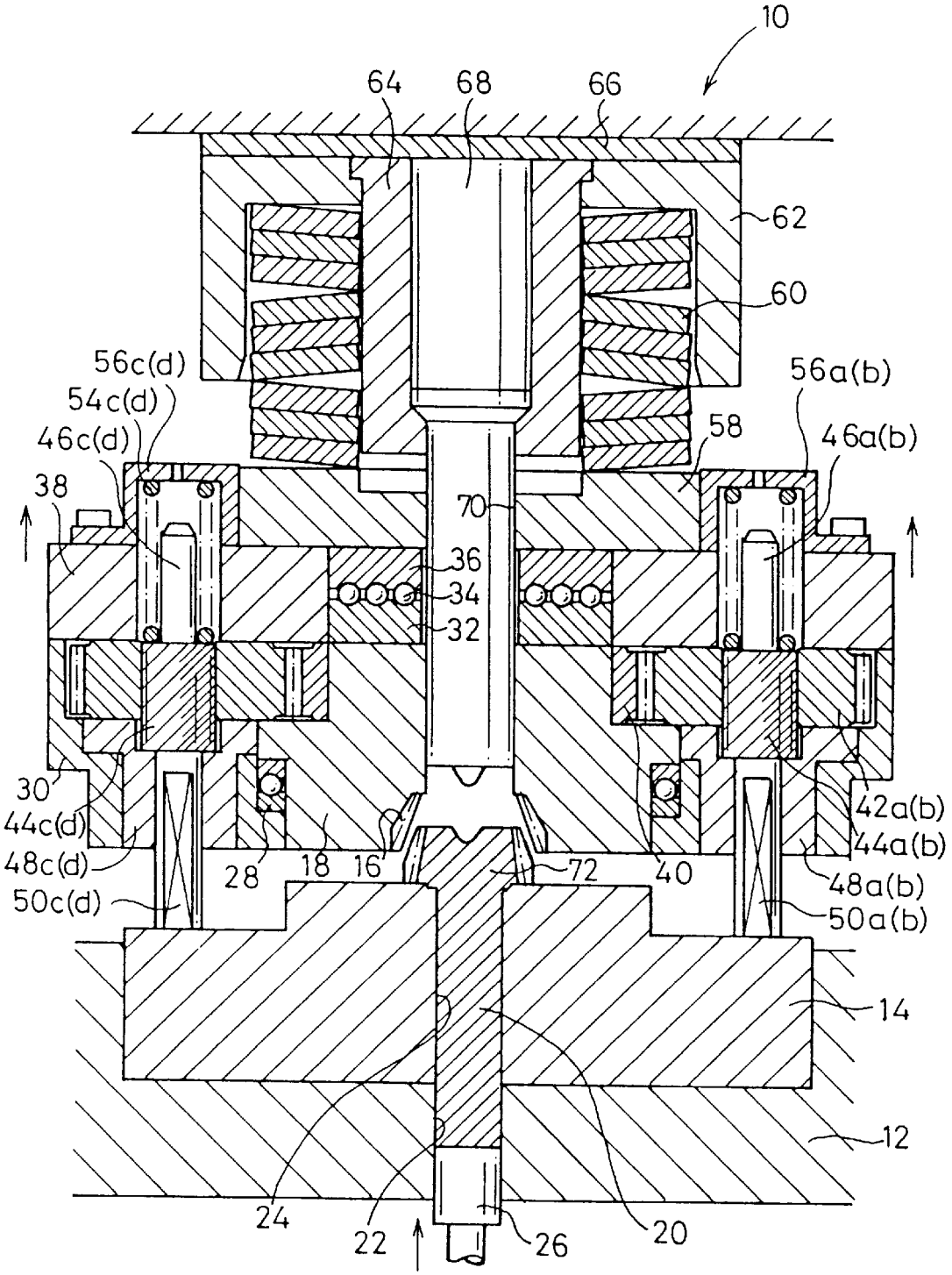
FIG. 5 is a vertical sectional view showing the condition of the forging apparatus of the first embodiment directly after die opening.

As a result, the upper die 18 is elevated while rotating, and the gear teeth forming die 16 which is formed in the upper die 18, becomes smoothly separated from the gear teeth of the spiral bevel gear 72. FIG. 5 shows the condition immediately after die separation of the upper die 18 from the spiral bevel gear 72. After displacement from this state to the condition shown in FIG. 1, by further raising of the upper mechanism of the forging apparatus, including the upper die 18, the knockout 26 which in inserted through the hole 22 of the die plate 12 is displaced upwardly, and the spiral bevel gear 72 is thereby separated from the lower die via the stem 20.

Figure 6:
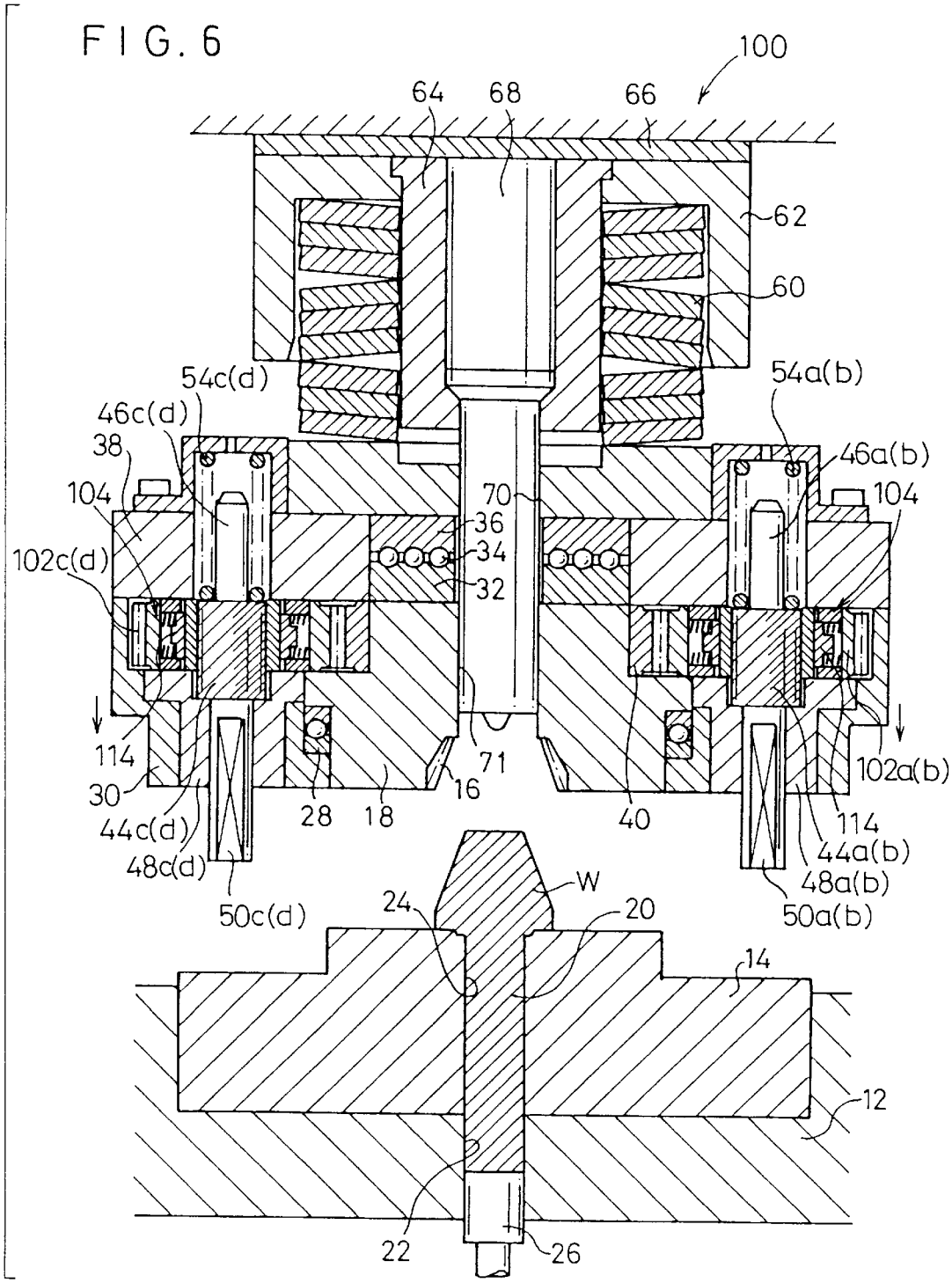
FIG. 6 is a vertical sectional view of a forging apparatus according to a second embodiment of the present invention.

FIG. 6 is a cross-sectional structural view of a forging apparatus 100 according to the second embodiment of the present invention. Structural elements which are the same as those of the forging apparatus 10 of the first embodiment are designated by like reference numerals, and detailed explanation thereof shall be omitted.

Figure 7:
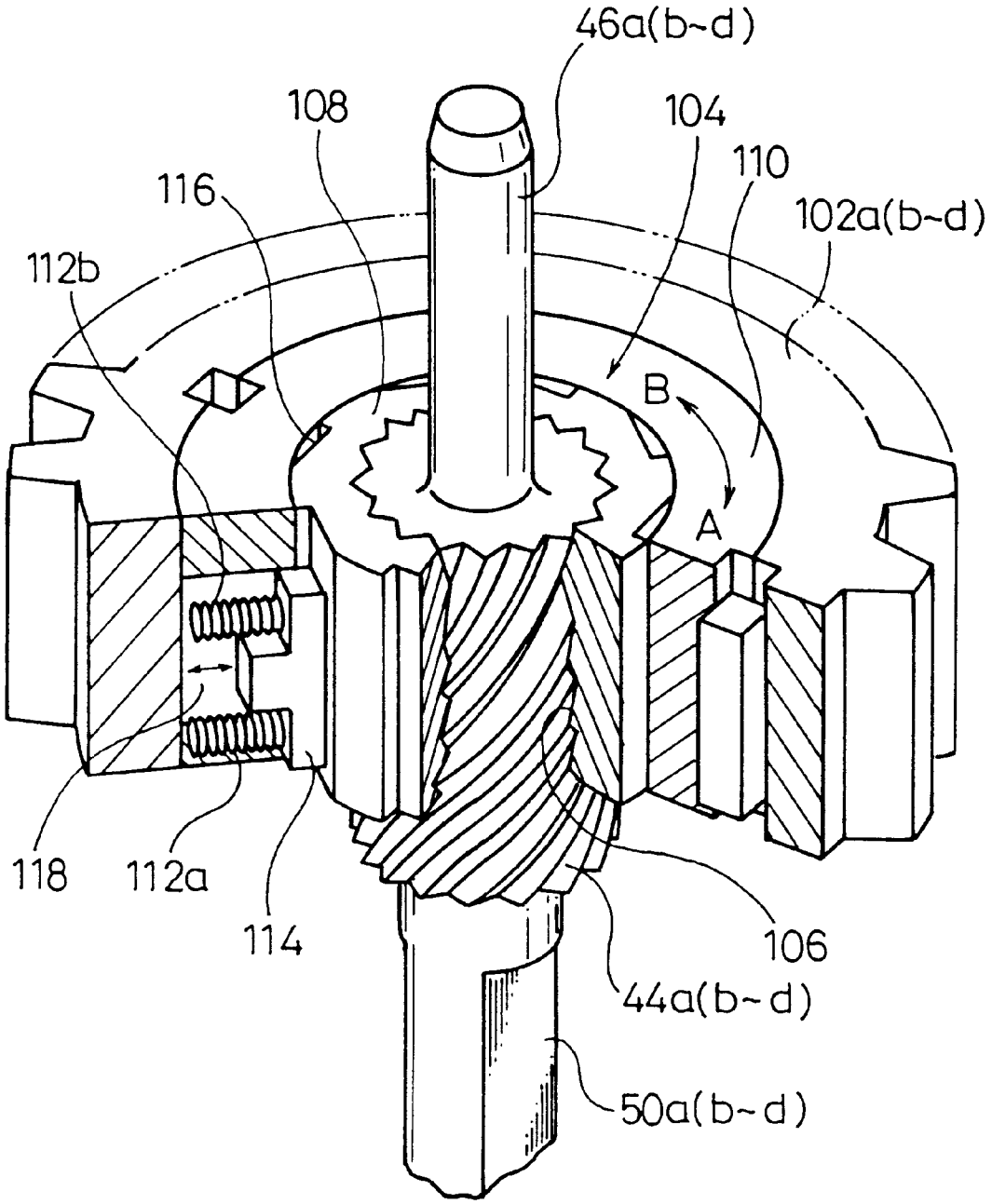
FIG. 7 is a partial cut-away perspective view of a rotation direction regulating mechanism as constructed in the forging apparatus according to the second embodiment.
Figure 8:
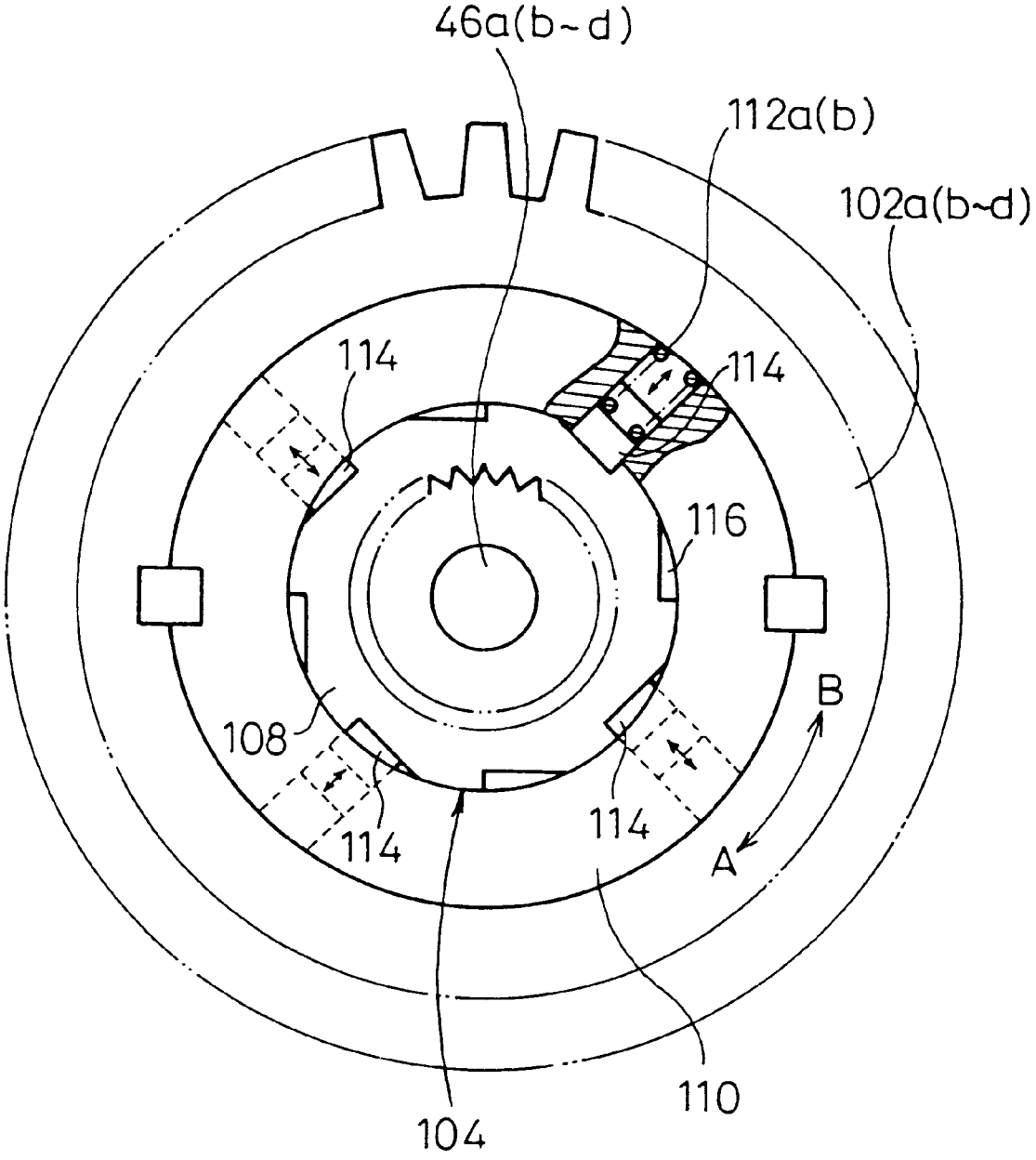
FIG. 8 is a partial cut-away plan view of the rotation direction regulating mechanism.

In the forging apparatus 100, a rotation direction regulating mechanism 104 is disposed in the drive gears 102*a*–102*d*, for allowing the drive gears 102*a*–102*d*, which are threadedly engaged with respective screws 44*a*–44*d*, to rotate in one direction only. As shown in FIGS. 6 through 8, the rotation direction regulating mechanism 104 comprises a ratchet member 108 having a screw hole 106 therein threadedly engaged with screws 44*a*–44*d*, a support ring 110 which rotatably accommodates therein the ratchet member 108, and a stop member 114 retractably disposed within the support ring 110, by which a force is applied against a side of the ratchet member 108 through coil springs (resilient bodies) 112*a*, 112*b*

A plurality of stop grooves 116, arranged alongside the respective stop members 114, are disposed at a fixed angular separation from each other on the outer peripheral surface of the ratchet member 108, wherein each of the stop grooves 116 has a step along an end side thereof. More specifically, as shown in FIGS. 7 and 8, the supporting 110 is permitted to rotate in the direction of the arrow B, whereas on the other hand, it is prevented from rotating in the direction of the arrow A. Four openings 118, which accommodate therein respective stop members 114, are disposed in the support ring 110 at equal angular separation. Each stop member 114 is retractably disposed within a respective opening 118 via coil springs 112*a*, 112*b*.

In the forging apparatus constructed in the manner described above, from the condition shown in FIG. 6, the upper die 18 is lowered with respect to the lower die 14 at a fixed rate, wherein the lower terminal ends of the screw shafts 46*a*–46*d* come into contact with the lower die 14. As the upper die 18 is lowered more, since the screws 44*a*–44*d* cannot be lowered further, the ratchet element 108, having a screw hole 106 therein which is threaded with screws 44*a*–44*d*, rotates in the direction of the arrow A.

At this time, the stop member 114 which is inserted into the stop groove of the ratchet member strikes the outer periphery of the ratchet member 108 and retracts, so the rotation of the ratchet member 108 is not transmitted to the drive gears 102*a*–102*d*. Accordingly, the upper die 18 is lowered without being rotated, and by the gear teeth forming die 16 formed in the upper die 18, an operation for forging the material is effected.

During the forging operation described above, since only the ratchet member 108 rotates in the direction of the arrow A, and since the rotation of the ratchet member 108 is not transmitted to the drive gears 102*a*–102*d*, the press speed is increased, and thus even if the inertial moment due to the mass of the upper die is large, a larger than necessary load does not act on the screw shaft 46*a*–46*d*. Accordingly, an effect is achieved whereby damage to the screw shaft 46*a*–46*d* can be prevented to the greatest extent possible.

On the other hand, when the upper die 18 is raised after forging, since the screws 44*a*–44*d* do not rise, the ratchet member 108 which is threadedly engaged with the screws 44*a*–44*d* rotates in the direction of the arrow B. Consequently, the stop member 114 engages with the stop grooves 116 of the ratchet member 108, and the drive gears 102*a*–102*d* are rotated integrally with the ratchet member 108. As a result, die opening occurs while at the same time the upper die 18 begins to rotate, and the gear teeth forming die 16 formed in the upper die 18 is smoothly released from the gear teeth of the spiral bevel gear 72.

Figure 9:
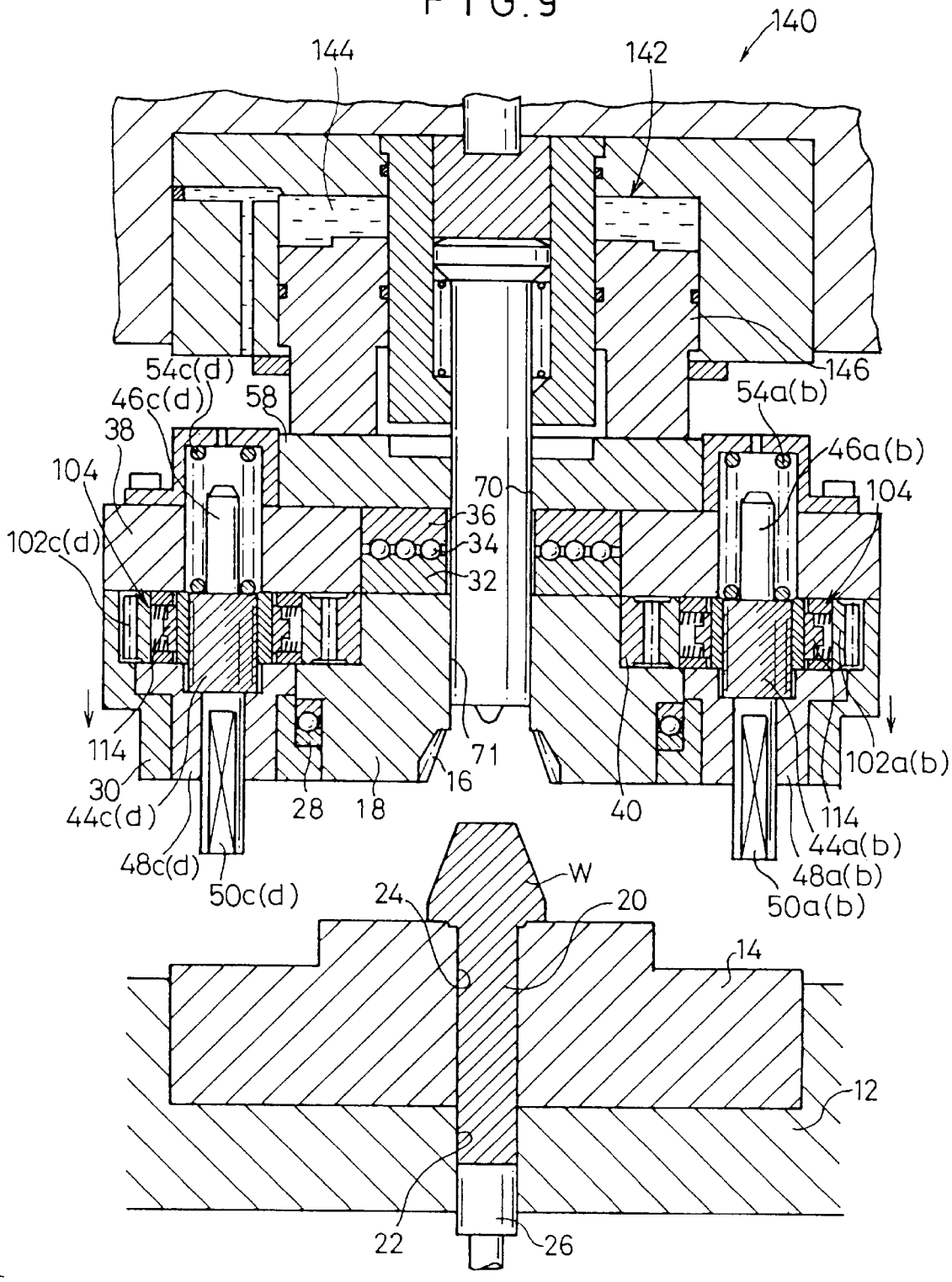
FIG. 9 is a vertical sectional view of a forging apparatus according to a third embodiment of the present invention.

FIG. 9 is a vertical cross-sectional structural view of a forging apparatus 140 according to the third embodiment of the present invention. Structural elements which are the same as those of the forging apparatus 100 of the second embodiment are designated by like reference numerals, and detailed explanation thereof shall be omitted.

The forging apparatus 140 comprises a hydraulic cylinder 142 in place of the plate springs 60 of the previous embodiments. The hydraulic cylinder 142 comprises a piston 146 which is displaceable up and down within a cylinder chamber 144, wherein the die plate 58 is fixedly attached to the lower end of the piston 146.

Figure 10:
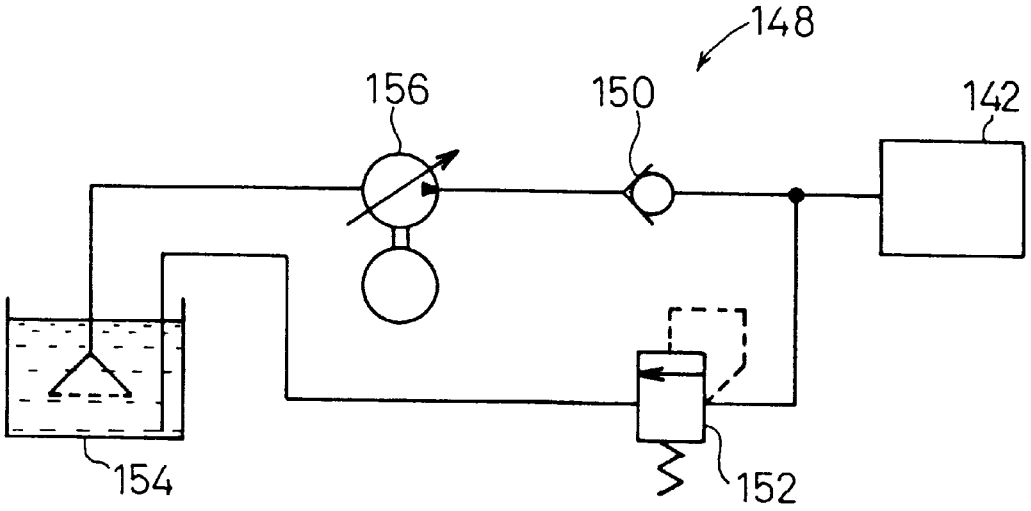
FIG. 10 is an outline schematic explanatory view of a hydraulic fluid supply circuit as constructed in the forging apparatus according to the third embodiment.

As shown in FIG. 10, a hydraulic fluid supply circuit 148 for conducting supply and evacuation of the hydraulic fluid to and from the hydraulic cylinder 142 is made up of a check valve 150 for permitting flow only in a direction of supplying hydraulic fluid to the hydraulic cylinder 142, and a relief valve 152 for allowing passage of the hydraulic fluid which is evacuated from the hydraulic cylinder 142, wherein hydraulic fluid is supplied from inside a tank 154 to the hydraulic cylinder 142 via a pump 156. The relief valve 152 can have an optionally variable set value.

In the forging apparatus constructed as described above, at die closing of the lower die 14 and upper die 18, hydraulic fluid inside the tank 154 is supplied to the cylinder chamber 144 of hydraulic cylinder 142 via pump 156. The pressure inside the cylinder chamber 144 is maintained by a back pressure obtained from controlling the hydraulic fluid level evacuated from the relief valve 152. Accordingly, through the hydraulic fluid pressure inside the cylinder chamber 144, the surface pressure of the upper die 18 and lower die 14 when in contact can be reliably maintained, and generation of burrs or mold flashing during forging of the material W can be prevented. More specifically, by optionally setting the set pressure of the relief valve 152, a desired surface pressure can be produced.

On the other hand, in the case that the volume of the material W is large, at the time of die closing, a considerably large load can easily be applied to the upper die 18 and the lower die 14. Thereupon, the hydraulic fluid is evacuated through the relief valve 152, and by lessening the surface pressure between the upper die 18 and the lower die 14, burrs or mold flashing caused by excess material W can be avoided. Accordingly, there is obtained an effect that breakdown of the forging apparatus 140 can be prevented to the greatest extent possible.

Figure 11:
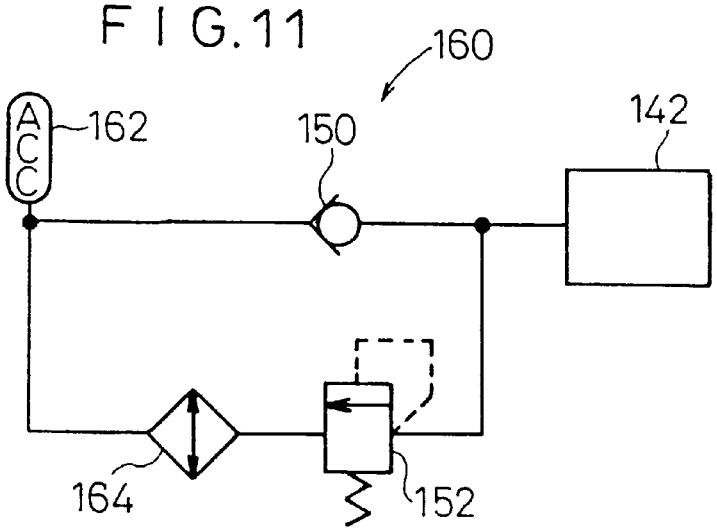
FIG. 11 is an outline schematic explanatory view of another hydraulic fluid supply circuit.
Figure 12:
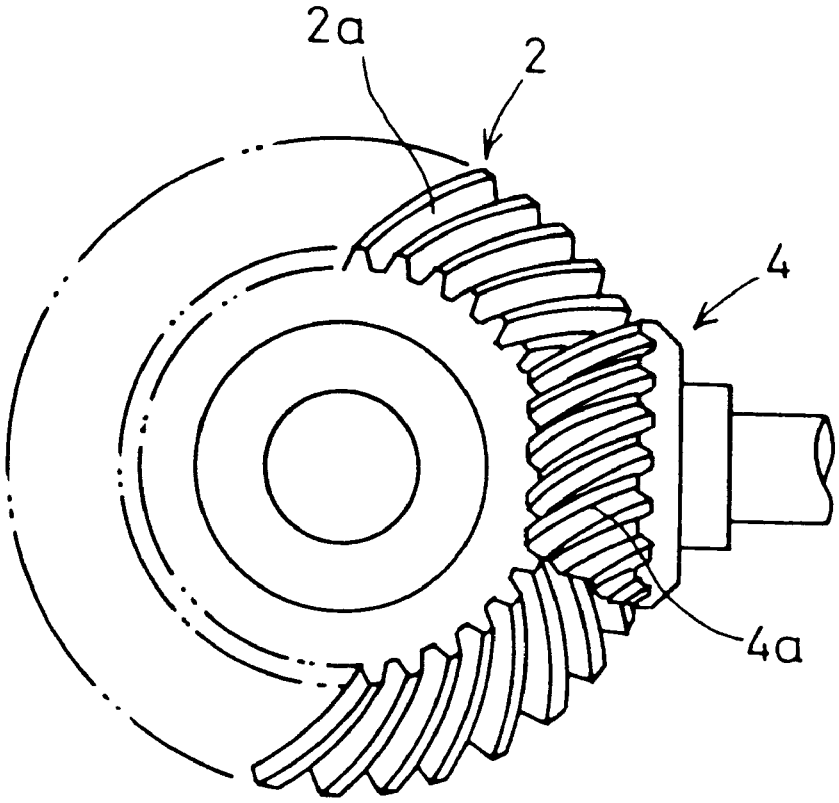
FIG. 12 is an explanatory drawing showing a spiral bevel gear.

FIG. 11 shows a hydraulic fluid supply circuit 160 having a different structure from that of the hydraulic fluid supply circuit 148. The hydraulic fluid supply circuit 160 is equipped with a check valve 150 and relief valve 152, together with an accumulator 162 through which the hydraulic fluid is circulated. For this purpose, the hydraulic fluid supply circuit 160 further comprises a cooling device 164 for cooling the considerably high temperature hydraulic fluid which is evacuated from the relief valve 152.

Further, because the hydraulic fluid supply circuit 148 is equipped with a reservoir tank 154 holding a predetermined amount of hydraulic fluid, there is no need for forcibly cooling the high temperature hydraulic fluid which is discharged from the relief valve. However, a cooling device 164 may also be provided therein, similar to the hydraulic fluid supply circuit 160, if desired.

INDUSTRIAL APPLICABILITY

As described above, according to the present invention, during die closing, because the upper die is solidly closed against the lower die by a force applying means, a bevel gear can be desirably formed under a stable die closing force. Further, at die opening, because die separation from the bevel gear is performed while the upper die is opened and simultaneously rotated through a screw held by a resilient member, there are no molding defects generated by operational delay during die opening or during mold release. Notwithstanding, the overall structure of the apparatus can be kept extremely simple.

What is claimed is:

1. A bevel gear hot-forging apparatus in which a material is forged under a condition of applied heat at a fixed temperature, for forming a bevel gear (72) having inclined gear teeth, comprising:

a first die (14) which accommodates therein a material (W) to be forged;

a second die (18) which is pressed under an applied force against said first die (14) by force applying means (60) for forming gear teeth in said material (W);

a driven gear (40) integrally attached to said second die (18);

a support frame (30, 38) for rotatably supporting said second die (18);

a drive gear (42*a*–42*d*) enmeshed with said driven gear (40) and supported by said support frame (30);

a screw (44*a*–44*d*) threadedly engaged with said drive gear (42*a*–42*d*) and supported by said support frame (30) while limiting rotation thereof, and having a projecting force applied thereto with respect to said first die (14) through a resilient member (54*a*–54*d*), wherein, at least when said second die (18) is displaced so as to be spaced from said first die (14), said driven gear (40) is rotated by means of said drive gear (42*a*–42*d*) threadedly engaged with said screw (44*a*–44*d*), and said second die (18) is rotated in correspondence with the inclination of said gear teeth.

2. The bevel gear hot-forging apparatus according to claim 1, wherein an outer periphery of said driven gear (40) is integrally enmeshed with a plurality of drive gears (42*a*–42*d*), and wherein respective threaded holes of said drive gears (42*a*–42*d*) are threadedly engaged with respective screws (44*a*–44*d*).

3. The bevel gear hot-forging apparatus according to claim 1, wherein said second die (18) comprises a center punch (68) for pressing said material (W) at the time of forging thereof.

4. The bevel gear hot-forging apparatus according to claim 1, wherein said first die (14) includes a knockout member (26) by which said material (W) is ejected after forging thereof.

5. The bevel gear hot-forging apparatus according to claim 1, wherein said force applying means comprises a plate spring (60).

6. The bevel gear hot-forging apparatus according to claim 1, wherein said force applying means comprises a hydraulic cylinder (142), and a hydraulic fluid supply circuit (148) for supplying and evacuating a hydraulic fluid from said hydraulic cylinder.

7. The bevel gear hot-forging apparatus according to claim 6, wherein said hydraulic fluid supply circuit (148) comprises a check valve (150) for permitting flow of said hydraulic fluid only in a direction toward said hydraulic cylinder (142), and a relief valve (152) for passage of hydraulic fluid which is evacuated from said hydraulic cylinder (142).

8. The bevel gear hot-forging apparatus according to claim 1, wherein said screw (44*a*–44*d*) is threadedly engaged with said drive gear (102*a*–102*d*), and further comprising a rotation direction regulating mechanism (104) for maintaining said drive gear (102*a*–102*d*) in a non-rotating state when said first die (14) and said second die (18) are displaced relatively into contact with each other, while rotating said drive gear (102*a*–102*d*) through said screw (44*a*–44*d*) when said first die (14) and said second die (18) are displaced relatively apart from each other.

9. The bevel gear hot-forging apparatus according to claim 8, wherein said rotation direction regulating mechanism (104) comprises a ratchet member (108) having a threaded hole (106) threadedly engaged with said screw (44*a*–44*d*), a support ring (110) rotatably accommodating said ratchet member (108), and a stop member (114) retractably disposed in said support ring (110), for applying force against the side of said ratchet member (108) through a resilient member (112*a*, 112*b*).

* * * * *